US005599000A

United States Patent [19]

Bennett

[11] Patent Number: 5,599,000

[45] Date of Patent: Feb. 4, 1997

[54] ARTICLE SECURING DEVICE

[76] Inventor: Terry R. Bennett, 15609 Saul Ct., Canyon Country, Calif. 91352

[21] Appl. No.: 406,730

[22] Filed: Mar. 20, 1995

[51] Int. Cl.[6] ..... A47B 97/00

[52] U.S. Cl. ..... 248/500; 24/171; 24/580; 24/581; 248/205.3

[58] Field of Search ..... 248/500, 505, 248/205.3, 551; 24/580, 581, 171

[56] References Cited

U.S. PATENT DOCUMENTS

| | | | |
|---|---|---|---|
| 960,593 | 6/1910 | Smith | 24/171 |
| 3,664,163 | 5/1972 | Foote | 248/551 X |
| 4,183,121 | 1/1980 | Cousins | 24/580 X |
| 5,208,952 | 5/1993 | Mintel et al. | 24/580 |
| 5,349,834 | 9/1994 | Davidge | 248/505 X |
| 5,431,365 | 7/1995 | Hopkins | 248/505 X |

*Primary Examiner*—Ramon O. Ramirez
*Assistant Examiner*—Michael J. Turgeon
*Attorney, Agent, or Firm*—Robert M. Sperry

[57] ABSTRACT

An article securing device having pairs of channel shaped retaining members which can be attached by pressure sensitive adhesive or small nails, screws or the like, together with flexible strap members which are insertable into the retaining members and can be fixedly, yet releasably retained, by latch members which mate with the retaining members to frictionally retain the strap members in engagement with the retaining members.

13 Claims, 6 Drawing Sheets

FIG. 7
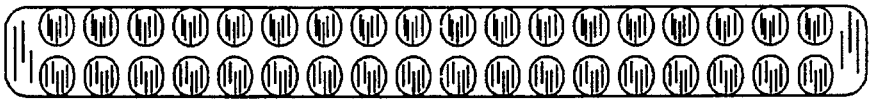
FIG. 8
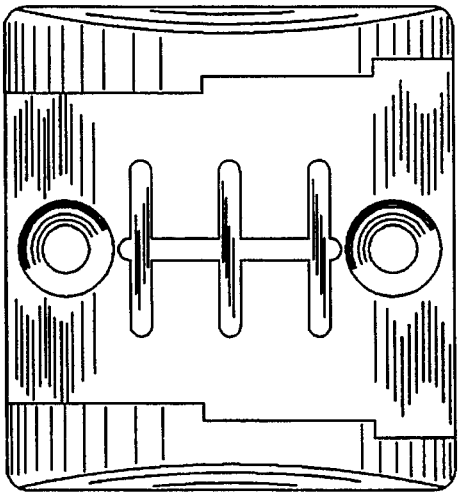
FIG. 9

ARTICLE SECURING DEVICE

FIELD OF INVENTION

This invention relates to anti-vibration devices and is particularly directed to means for releasably securing furniture, stereo speakers, pictures and other articles against undesired movement caused by earthquakes or other heavy vibration.

PRIOR ART

Earthquakes and other heavy vibration often overturn large pieces of furniture, such as bookcases, china cabinets and the like and to displace articles placed on shelves, ledges and the like, causing such articles to fall onto the floor and be smashed. For many years, such damage was considered to be an unavoidable risk of living in areas which were subject to earthquakes or other heavy vibration. More recently, it has been suggested to secure many such furniture and articles, using rigid support means, such as angle irons and the like. However, these rigid support means are unsightly and must be attached to a wall or the like by means of relatively large bolts or screws. Unfortunately, if the furniture is rearranged, these bolts or screws leave large and unsightly holes in the wall or other supporting structure, so that expensive plastering or papering is required to cover these holes. Furthermore, many small articles, such as vases, statuettes and the like are formed of frangible material, which cannot tolerate penetration by such bolts or screws. Numerous other types of article securing devices have been proposed. However, many of these prior art devices have been expensive to purchase and difficult to install. Other prior art article securing devices have simply failed to adequately restrain the desired articles. Thus, none of the prior art article securing devices have been entirely satisfactory.

BRIEF SUMMARY AND OBJECTS OF INVENTION

These disadvantages of the prior art are overcome with the present invention and improved article securing devices are proposed which are inexpensive to purchase and which can be installed quickly and easily, even by person of little mechanical skill, but which firmly, yet releasably, retain desired articles or pieces of furniture against undesired movement caused by earthquakes or other heavy vibration, without damaging such furniture or other articles, and which allow such furniture or articles to be moved or rearranged, if desired, with little, if any, damage to the supporting structure.

These advantages of the prior art are preferably attained by providing improved article securing devices having pairs of channel shaped retaining members which can be attached by pressure sensitive adhesive or small nails, screws or the like, together with flexible strap members which are insertable into the retaining members and can be fixedly, yet releasably retained, by latch members which mate with the retaining members to frictionally retain the strap members in engagement with the retaining members.

Accordingly, it is an object of the present invention to provide improved article securing devices.

Another object of the pressent invention is to provide improved article retaining devices which are inexpensive to purchase and which can be installed quickly and easily, even by person of little mechanical skill.

An additional object of the pressent invention is to provide improved article retaining devices which firmly, yet releasably, retain desired articles or pieces of furniture against undesired movement caused by earthquakes or other heavy vibration.

A further object of the pressent invention is to provide improved article retaining devices which retain desired articles or furniture against undesired movement caused by earthquakes or other heavy vibration without damaging such furniture or other articles.

Another object of the present invention is to provide improved article retaining devices which allow furniture or articles to be moved or rearranged, if desired, with little, if any, damage to the supporting structure.

A specific object of the present invention is to provide improved article securing devices having pairs of channel shaped retaining members which can be attached by pressure sensitive adhesive or small nails, screws or the like, together with flexible strap members which are insertable into the retaining members and can be fixedly, yet releasably retained, by latch members which mate with the retaining members to frictionally retain the strap members in engagement with the retaining members.

These and other objects and features of the present invention will be apparent from the following detailed description, taken with reference to the figures of the accompanying drawing.

BRIEF DESCRIPTION OF THE DRAWING

FIG. 7 is a side view of the strap member of FIG. 6;

FIG. 8 is a bottom view of the strap member of FIG. 6;

FIG. 9 is a plan view of one of the retaining members of the article securing device of FIG. 1;

DETAILED DESCRIPTION OF THE INVENTION

Figure 1:
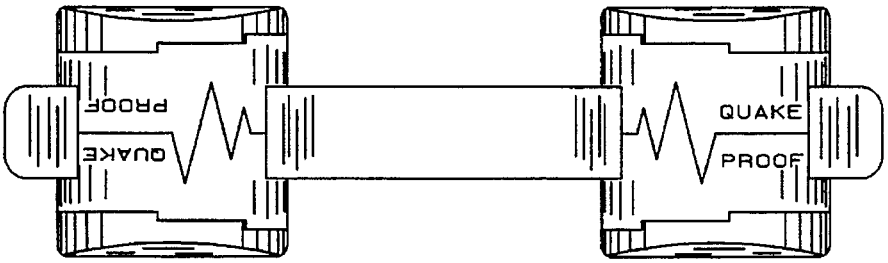
FIG. 1 is a plan view of an article securing device embodying the present invention.
Figure 2:
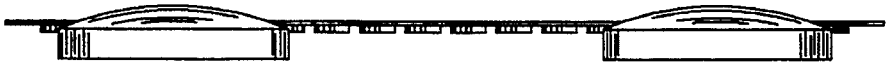
FIG. 2 is a side view of the article securing device of FIG. 1.
Figure 3:
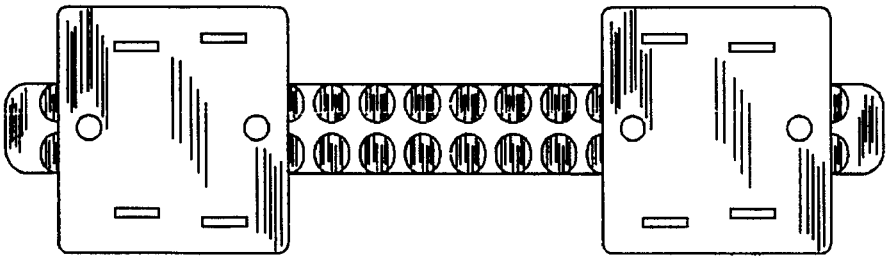
FIG. 3 is a bottom view of the article securing device of FIG. 1.
Figure 4:
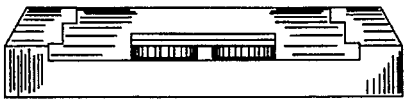
FIG. 4 is an end view of the article securing device of FIG. 1.
Figure 5:
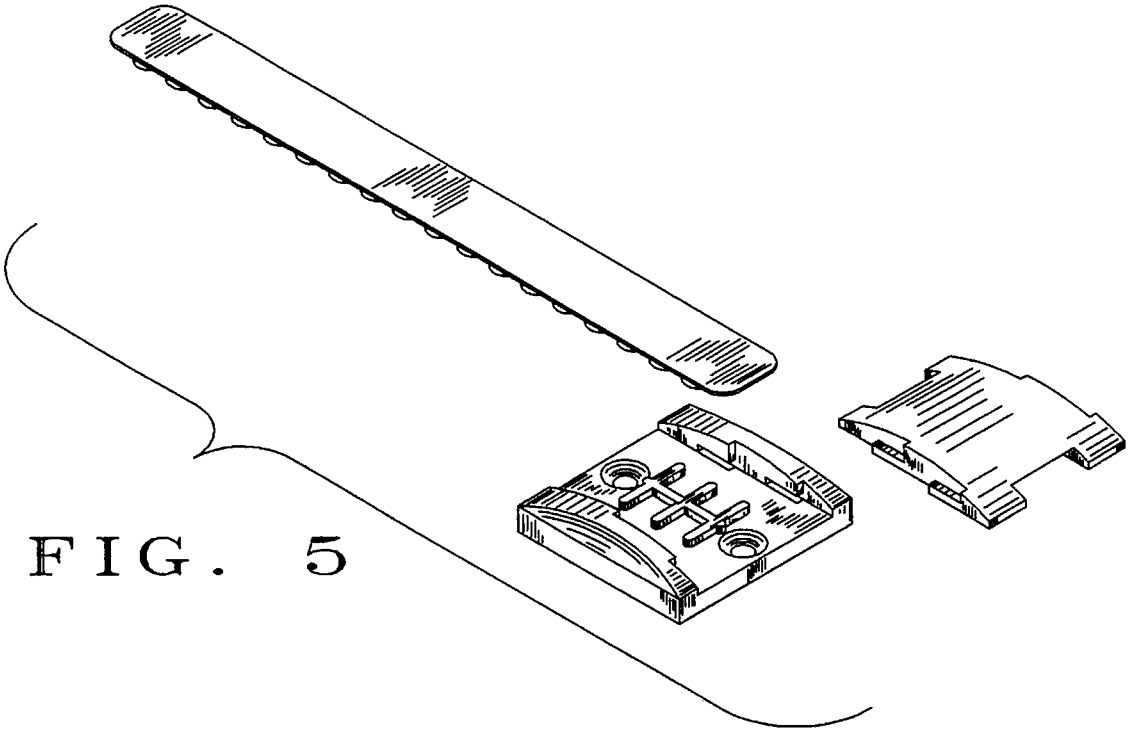
FIG. 5 is an exploded view of the article securing device of FIG. 1.
Figure 6:
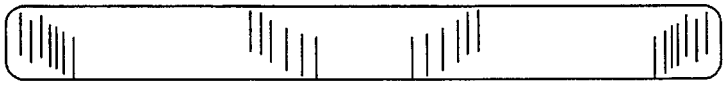
FIG. 6 is a plan view of the strap member of the article securing device of FIG. 1.
Figure 10:
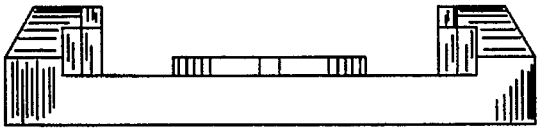
FIG. 10 is an end view of the retaining member of FIG. 9.
Figure 11:
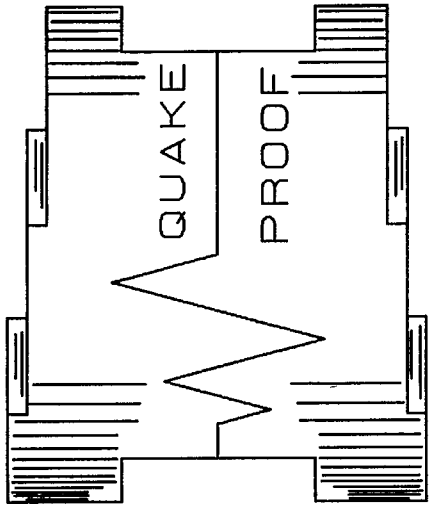
FIG. 11 is a plan view of one of the latch members of the article securing device of FIG. 1.
Figure 12:
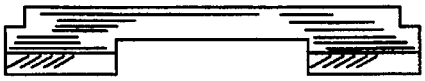
FIG. 12 is an end view of the latch member of FIG. 11.
Figure 13:
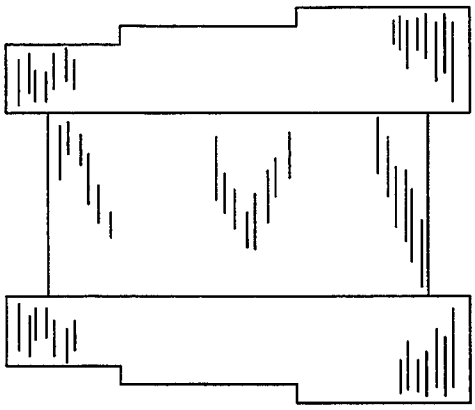
FIG. 13 is a bottom view of the latch member of FIG. 11.

In that form of the present-invention chosen for purposes of illustration in FIGS. 1–4, an article securing device, indicated generally at 10, is shown comprising a pair of retaining members 12 and 14 having a flexible strap member 16 firmly, yet releasably, secured to the retaining members 12 and 14 by a pair of latch members 18 and 20, which mate with the retaining members 12 and 14 to frictionally retain the strap member 16 within the retaining members 12 and 14. As shown, the retaining members 12 and 14 may be provided with holes 22 to receive small diameter nails, screws or the like for releasably attaching the respective retaining member 12 or 14 to an article to be protected or to a supporting structure, such as a wall. Alternatively, if desired, pads 24 of pressure sensitive adhesive may be provided on the bottom surfaces 26 of the retaining members 12 and 14 to allow the retaining members to be attached to an article or supporting structure without making a hole therein. As best seen in FIGS. 5, and 10, the retaining members 12 and 14 are generally channel shaped and are each formed of rigid material with an upper surface 28 having generally parallel side walls 30 and 32 which project upwardly along respective sides of the upper surface 28. As best seen in FIGS. 1, 5 and 9, the side walls 30 and 32 are stepped inwardly at 34 and 36 to provide recesses 38 and 40 within the side walls 30 and 32. This assures that the latch members 18 and 20 can be inserted in only one direction and cannot be pushed completely through the retaining member 12 or 14. Also, a raised portion 42 is provided extending generally axially along the upper surface 28 of the retaining members 12 and 14. The strap member 16 is an elongated flexible member having a flat upper surface 44 and and having the lower surface 46 formed with a plurality of projections 48 which are configured to mate with the raised portion 42 on the upper surface 28 of the retaining members 12 and 14. Finally, as best seen in FIGS. 1, 4, 5, 11, 12 and 13, a pair of latch members 18 and 20 are provided, each having a relatively flat upper surface 50 with a pair of side walls 52 and 54 which project downwardly from respective edges of the upper surface 50 to form a channel 56 on the under side of the latch member 18 or 20. The outer edges 58 and 60 of the side walls 52 and 54 are formed with outwardly projecting flanges 62 and 64 which mate with the recesses 38 and 40 of the side walls 30 and 32 of the retaining members 12 and 14. If desired, detents 61 may be provided on the upper surfaces of the flanges 62 and 64 to frictionally engage recesses 63 formed in the side walls 30 and 32 of the retaining members 12 to frictionally retain the latch members 18 and 20 in locked relationship with the retaining members 12 to prevent inadvertent disengagement of the latch members 18 and 20.

In use, one of the retaining members, for example, retaining member 12, is attached to an article to be protected, not shown, either by means of the pressure-sensitive adhesive pads 24 or by inserting nails, screws or the like through the holes 22. Similarly, the other retaining member 14 is attached to an adjacent supporting structure, such as a wall, not shown, in the same manner. Next, the ends of the strap member 16 are placed on the upper surfaces 28 of both of the retaining members 12 and 14 with the lower surface 46 of the strap member 16 facing the upper surface 28 of the retaining members 12 and 14, so that the projections 48 of the strap member 16 mate with the raised portions 42 of the retaining members 12 and 14. Finally, the latch members 18 and 20 are placed on top of the respective ends of the strap member 16 and are inserted between the side walls 30 and 32 of the retaining members 12 and 14 so that the flanges 62 and 64 of the latch members mate with the recesses 38 and 40 of the retaining members 12 and 14 to frictionally retain the latch members 18 and 20 within the retaining memebrs 12 and 14. This serves to sandwich the strap member 16 between the latch members 18 and 20 and the respective retaining members 12 and 14 so that the strap member is securely, yet releasably locked in place and serves to firmly attach the article attached to retaining member 12 to the supporting structure attached to retaining member 14. Because the strap member 16 is flexible, some movement is tolerated between the article being protected and the supporting structure. However, no significant movement of the protected article can occur, so the article is securely portected against movement which could cause damage to the protected article. On the other hand, should the user desire to rearrange the protected articles, the latch members 18 and 20 can quickly and easily be pushed out of engagement with the retaining members 12 and 14. The latch members 18 and 20 can, then, be removed to allow removal of the strap member 16 and, hence, to release the protected article for relocation. Moreover, since the retaining members are attached to be protected article or the supporting structure by small diameter nails or screws or by use of the pressure-sensitive adhesive pads 24, little or no damage will be caused to the protected article or supporting structure by removal of the retaining memebrs 12 and 14.

Figure 14:
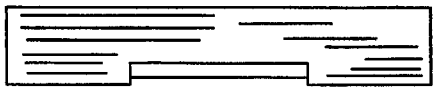
FIG. 14 is an end view of an alternative form of retaining member for use with the article securing device of FIG. 1.
Figure 15:
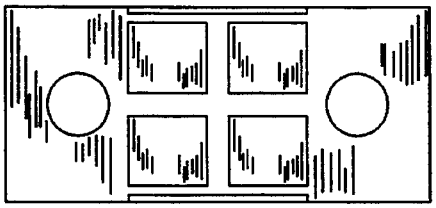
FIG. 15 is a bottom view of the retaining member of FIG. 14.
Figure 16:
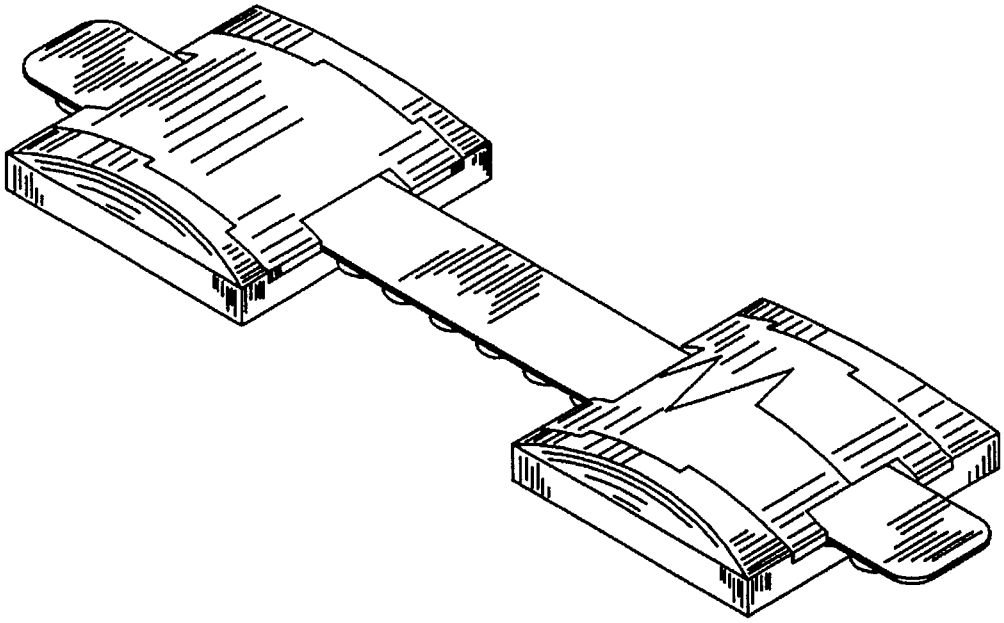

FIGS. 14 and 15 show an alternative form of retaining member 66 for use with the strap member 16 of FIG. 1 to secure articles or furniture, not shown, to a supporting structure, not shown. The retaining member 66 has a relatively flat upper surface 68 and has a pair of side walls 70 that extend downwardly from the upper surface 68 and serve to define a central channel 72 which is dimensioned to mate with the thickness of the strap member 16 of FIG. 1. The inner surface of the channel 72 is formed with a plurality of recesses 74 which are configured to mate with the projections 48 on the bottom surface 46 of the strap member 16. The retaining members 66 are provided with holes 76 to receive small diameter nails, screws or the like for attaching the retaining member 66 to an article to be protected, not shown, or to a supporting structure, such as a wall, not shown. Alternatively, pads 78 of pressure-sensitive adhesive may be provided on the underside 80 of the retaining member 66.

In use, the strap member 16 is placed in the desired location with the bottom surface 46 facing upward and the retaining member 66 is placed on top of the strap member 16, adjacent one end of the strap member 16, with the recesses 74 of the retaining member 66 mating with the projections 48 of the strap member 16. Then, the retaining member 66 is attached to the article to be protected, either by inserting nails or screws through the holes 76 of the retaining member 66 or by means of the pressure-sensitive pads 78. Finally, a second one of the retaining members 66 is placed on top of the strap member 16, adjacent the opposite end, and is secured to the supporting structure in the same manner as described for attaching the article to be protected. The retaining members 66 have the advantage of being smaller and, hence, less conspicuous than the retaining members 12 and 14. However, the retaining members 12 and 14 are more easily removed and reattached for relocating the protected articles.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. An article securing device comprising:

a strap member having a contoured surface, a pair of retaining members each formed with side walls defining a central channel for receiving said strap and having a surface of said channel formed to mate with the contoured surface of said strap, means for attaching said retaining members to an article to be secured, said side walls having portions projecting inwardly to overlie a portion of said channel and forming recesses in said side walls adjacent said channel, and a latch member having flanges engageable with said recesses to frictionally retain said latch member in engagement with said retaining member.

2. The article securing device of claim 1 wherein:

one of said desired articles is an article to be protected.

3. The article securing device of claim 1 wherein:

one of said desired articles is a supporting structure.

4. The article securing device of claim 1 wherein:

said strap is flexible.

5. The article securing device of claim 1 wherein:

said retaining members are formed of rigid material.

6. The article securing device of claim 1 wherein:

said latch member is formed with a channel for receiving said strap and serves to lock said strap into engagement with said retaining member.

7. The article securing device of claim 1 wherein:

said retaining member is formed to permit insertion of said latch member in only one direction.

8. The article securing device of claim 1 wherein:

said channel is formed on an upper surface of said retaining member.

9. The article securing device of claim 1 wherein:

said channel is formed on an bottom surface of said retaining member.

10. The article securing device of claim 1 wherein:

said means for attaching said retaining members are holes extending through said retaining members to receive an attaching device.

11. The article securing device of claim 10 wherein:

said attaching device is a nail.

12. The article securing device of claim 10 wherein:

said attaching device is a screw.

13. The article securing device of claim 10 wherein:

said attaching device is a pad of pressure-sensitive adhesive.

* * * * *